United States Patent [19]

Nomiyama

[11] 4,185,331

[45] Jan. 29, 1980

[54] PROTECTIVE HEAD DEVICE

[76] Inventor: Tetsuo T. Nomiyama, 1526 Century Blvd., Santa Ana, Calif. 92703

[21] Appl. No.: 942,300

[22] Filed: Sep. 14, 1978

[51] Int. Cl.[2] ..... A42B 1/08; A63B 71/10

[52] U.S. Cl. ..... 2/411; 2/425

[58] Field of Search ..... 2/2 R, 2 A, 2.5, 6, 2/9, 411, 412, 414, 425

[56] References Cited

U.S. PATENT DOCUMENTS

| | | | |
|---|---|---|---|
| 1,238,120 | 8/1917 | Flanagan | 2/2.5 |
| 1,276,200 | 8/1918 | Flanagan | 2/2.5 |
| 2,607,036 | 8/1952 | McCoy | 2/425 |
| 3,153,242 | 10/1964 | Nedwick | 2/411 |
| 3,174,155 | 3/1965 | Pitman | 2/411 |
| 3,953,892 | 5/1976 | Kennedy et al. | 2/425 |
| 4,012,794 | 3/1977 | Nomiyama | 2/6 |

*Primary Examiner*—Louis Rimrodt
*Attorney, Agent, or Firm*—Francis X. LoJacono

[57] ABSTRACT

A protective head device for use in sporting games and particularly designed as a bicyclist's protective helmet, wherein the device includes inner and outer shock-absorbing band members, the outer band being capable of linear movement relative to the inner band. The inner band is secured to a plurality of head straps in a stationary manner with respect to the head of the user. A bearing mechanism is interposed between the inner and outer bands to allow movement of the outer band, upon impact, relative to the inner band. Thus, the force of the impact is greatly reduced thereby preventing serious injury to the wearer thereof.

5 Claims, 4 Drawing Figures

FIG. 1
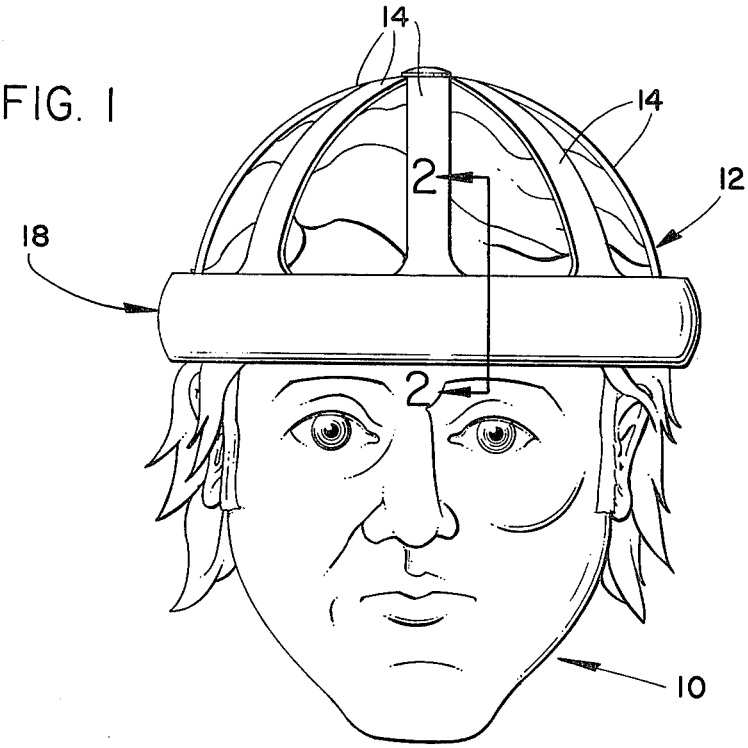
FIG. 2
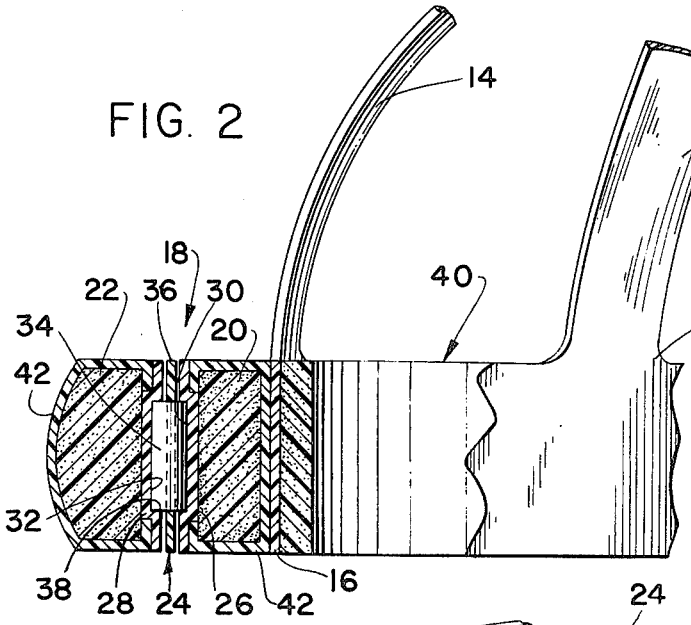
FIG. 4
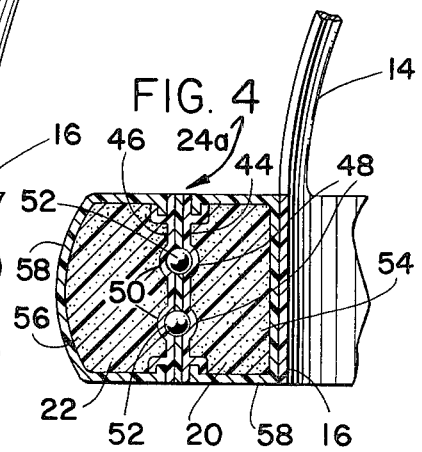
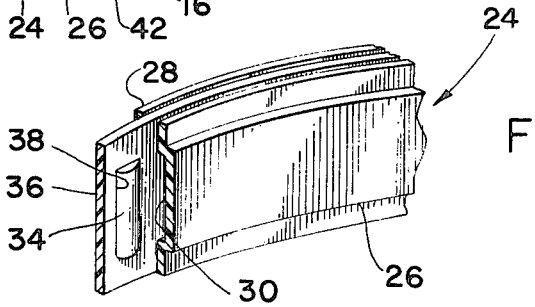
FIG. 3

PROTECTIVE HEAD DEVICE

BACKGROUND OF THE INVENTION

1. Field of the Invention

This invention relates generally to a protective head device, and more particularly to a protective head device having a means to absorb impact thereto by causing movement between a fixed band member and a movable band member.

2. Description of the Prior Art

As is well known in the art, various problems and difficulties are encountered in providing suitable head-protection means for bicyclists.

Several types of head-protection devices are used at the present time; however, these devices have features which are not designed to absorb to a maximum degree the impact forces of the type that generally are encountered when one is thrown from a moving bicycle. That is, when a cyclist falls from a bicycle, he or she is thrown against an object or road surface with a great force, allowing the head to impact with a glancing blow. The known helmets are so constructed that all the elements of the structure are stationary with respect to the head.

Accordingly, if a member of the head gear were to be made movable—particularly rotatable about the head—then, upon impact therewith, the forces could be additionally absorbed by the movable member.

Hence, as will be herein disclosed by the present invention, the additional safety of the cyclist will be provided by its unique shock-absorbing construction.

SUMMARY OF THE INVENTION

The present invention comprises a protective head device, particularly for bicyclists when thrown from moving bicycles The device is constructed having a plurality of head straps or like helmet-supporting means which are attached to an inner head band member, the inner head band being held substantially stationary with respect to the wearer's head. A second outer band is provided and is capable of being moved annularly about the fixed band member upon impact thereon. To provide the movement between the inner and outer bands, there is interposed therebetween a bearing mechanism which comprises a pair of oppositely disposed raceway channels adapted to receive a plurality of spaced bearing members between the raceway channels. Thus, the first raceway channel is secured to the inner, substantially fixed, shock-absorbing band which prevents its movement; and the second raceway channel is secured to the outer movable band, whereby the outer band and its respective raceway is capable of annular movement about the inner raceway and band member.

It should be noted that, as an accident involving a bicyclist occurs, it generally happens while the cyclist is in a a forward motion, thereby throwing him against an object or ground with a glancing blow. This glancing blow can not only cause head injuries but, in addition, can cause associated neck and back injuries as well, due to the forward motion of the body on impact. Thus, the present device allows the impact forces to be dissipated or totally absorbed by the movement of the outer band member.

OBJECTS AND ADVANTAGES OF THE INVENTION

The present invention has for an important object a provision wherein the additional glancing impact forces received to the head of a bicyclist during a fall are absorbed and dissipated, thus reducing the chance of serious innury.

It is another object of the invention to provide a protective head device for bicyclists wherein the device includes an outer movable band member which will move annularly about the stationary portion of the device.

It is still another object of the invention to provide a device of this type that includes an annular bearing means interposed between a movable band and a substantially fixed band, allowing the movable band to move about the fixed band and thereby absorbing the impact forces to prevent injury to the wearer thereof.

It is further an object of the invention to provide a helmet of this character which is easily adjustable for the various head sizes.

It is still another object of the invention to provide a device of this character that is superior to known head gear, and that is yet relatively inexpensive to manufacture.

Still another object of the invention is to provide a safety helmet having shock-absorbing moving parts that is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particulary to the accompanying drawings, which are for illustrative purposes only:

FIG. 1 is a front-elevational view of the present invention shown mounted to an individual's head;

FIG. 2 is an enlarged cross-sectional view taken substantially along line 2—2 of FIG. 1, wherein the bearings shown therein are roller bearings;

FIG. 3 is a partial perspective view of the bearing mechanism provided in the preferred embodiment; and FIG. 4 is a cross-sectional view illustrating an alternative arrangement of the bearing mechanism.

DESCRIPTION OF THE PREFERRED EMBODIMENT

Referring more particularly to FIG. 1, there is shown a head of an individual, generally indicated at 10, which represents a bicyclist and the wearer of the present invention, said invention being a protective head device, designated generally at 12, mounted on said wearer 10.

As can be seen, the protective head device is positioned so that the lower portion of the device is located about the forehead, over the temples and to the sides just over the ears. These areas are the most critical ones in serious head injuries to the cyclist during an accident or fall from a moving bicycle.

This particular protective head device is desiged to absorb and/or dissipate glancing blows to the head of the cyclist, this not being the case with known protective head gear. Thus, the protective head device 12 comprises a mounting means which is defined by a plurality of strap members 14 formed to provide a dome to receive the wearer's head. Various suitable mounting means can be employed and can be made from materials such as polycarbonate, which provides flexibility, strength and durable wear. Polycarbonate is suggested because it is also shatterproof, and rigid enough to allow impact forces to be equally distributed over a large area of the head.

Strap members merge together at the top of the dome and extend downwardly, the members being integrally formed with a base member 16 having an annular configuration flexible enough to adjust to the configuration of the head of the wearer 10.

A shock-absorbing means, indicated generally at 18, is mounted to the outer side of base band member 16, wherein the shock-absorbing means comprises a first inner shock-absorbing band member 20 which is directly affixed to base band 16, as seen in FIG. 2. A second shock-absorbing band 22 is provided and defines a movable outer band wherein each band 20 and 22 is formed from a soft pliable foam plastic or rubber material.

Interposed between the inner shock-absorbing band 20 and the outer shock-absorbing band 22 is a bearing means, generally designated at 24, which is illustrated in FIGS. 2 and 3. Bearing means 24 comprises a pair of bearing-receiving raceways 26 and 28 which are oppositely disposed in a right-and-left-hand arrangement. Each raceway is formed having a channel 30 and 32, respectively, wherein the respective channels face each other so as to receive a plurality of roller bearings 34 therein. Roller bearings 34 are equally spaced apart, and are held in such spaced relation to each other by means of a bearing-cage member 36 provided with appropriate slots 38.

Accordingly, raceway 26 is secured to inner band 20 which is secured to base band 16; and, thus, all of the respective elements are substantially fixed with respect to the wearer's head. However, raceway 28 is positioned to move relative to raceway 26, whereby the outer band 22—being affixed to raceway 28—will move linearly about the fixed elements.

It is contemplated that suitble rigid but flexible materials will form the raceways, so as to conform to the configuration about the head of the wearer. It should be stressed and noted that the outer elements 22 and 28 do not necessarily rotate freely. That is, raceway 28 will move under impact forces, so that the forces received or impinged on absorber band 22 can be transferred to raceway 28 in order for raceway 28 to move linearly with respect to raceway 26. Hence, the glancing impact received by band 22 is dissipated by the movement of raceway 28. Any further shock is absorbed in the inner shock band 20. Due to the rigid but flexible construction of the raceways, they will always resume the general configuration of the wearer's head 10.

It is further contemplated that a resilient head band 40 will be removably mounted to the inner side of base band 16, as seen in FIG. 2. This band will further provide shock protection—but, in addition, will allow for better fitting of the device to the wearer's head. That is, the thickness of head band 40 can be changed to accommodate the different head sizes of individuals.

It should also be noted that the inner and outer bands 20 and 22, respectively, will be provided with outer protective covers 42. These covers can be made of any suitable material, such as leather or vinyl.

An alternative arrangement of the bearing means 24*a* is illustrated in FIG. 4. This bearing arrangement comprises a pair of bearing-receiving raceways 44 and 46, wherein each raceway includes one or more bearing-receiving channels 48 and 50, respectively.

The channels are formed in a semicircular manner whereby channels 48 face channels 50, thus allowing ball bearings 52 to be disposed therebetween. There is further included a bearing-cage member 54 which is interposed between each raceway member, thereby positioning each bearing in its spaced relationship to its adjacent bearing.

Hereto, in this arrangement shock-absorbing inner and outer bands 54 and 56, respectively, are provided—as previously described herein—including cover members 58.

It should be understood that full free rotation of the outer raceway 46 and its associated shock-absorbing band 56 is not necessary. That is, the raceways can be made of a rigid but flexible plastic material, allowing the raceways to conform to a substantially out-of-round configuration, whereby the outer portion of the shock-absorbing means is capable of moving only during impact, and wherein the shock is substantially dissipated thereby.

The invention and its attendant advantages will be understood from the foregoing description; and it will be apparent that various changes may be made in the form, construction and arrangement of the parts of the invention without departing from the spirit and scope thereof or sacrificing its material advantages, the arrangement herein before described being merely by way of example; and I do not wish to be restricted to the specific form shown or uses mentioned, except as defined in the accompanying claims.

I claim:

1. In combination, a protective head device comprising:

a dome head-receiving member having a base band to fit about the wearer's head;

a resilient head band secured to the inner side of said base band;

shock-absorbing means mounted to the outer side of said base band arranged to dissipate shock received upon impact thereto; and bearing means interposed within said shock-absorbing means to allow a portion of said shock-absorbing means to move relative to said base band;

said shock-absorbing means comprising an inner shock absorbing band member secured to said base member in a substantially fixed position, and an outer shock-absorbing band member attached to said bearing means so as to move relative to said inner shock-absorbing band; and wherein said bearing means comprises:

a first raceway secured to said inner shock-absorbing band member, whereby said first raceway is relatively stationary with respect to said base band;

a second raceway oppositely disposed to said first raceway for relative movement therebetween wherein said outer shock-absorbing band is affixed to said second raceway so as to move therewith upon impact thereto;

a plurality of bearing members interposed between each of said raceways; and a bearing cage member to hold said bearing in respective adjacent positions within said raceways.

2. The combination as recited in claim 1, wherein each of said raceways is formed with at least one continuous channel therein, wherein each channel is positioned opposite to the other, and wherein said bearings are disposed therein to allow movement of said second raceway.

3. The combination as recited in claim 2, wherein each of said shock-absorbing bands comprises a soft pliable foam material having an outer protective cover mounted thereon.

4. The combination as recited in claim 3, wherein said channels in said raceways are semicircular in cross-section.

5. The combination as recited in claim 3, wherein said dome comprises a plurality of strap members integrally formed with said base band.

* * * * *